US006997631B2

(12) United States Patent
Yamada et al.

(10) Patent No.: US 6,997,631 B2
(45) Date of Patent: Feb. 14, 2006

(54) APPLICATOR

(75) Inventors: Norio Yamada, Tokyo (JP); Ryusuke Ota, Tokyo (JP)

(73) Assignee: Pentel Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/511,380

(22) PCT Filed: May 29, 2003

(86) PCT No.: PCT/JP03/06732

§ 371 (c)(1),
(2), (4) Date: Oct. 14, 2004

(87) PCT Pub. No.: WO03/101760

PCT Pub. Date: Dec. 11, 2003

(65) Prior Publication Data

US 2005/0169691 A1 Aug. 4, 2005

(30) Foreign Application Priority Data

May 31, 2002 (JP) ..... 2002-160003
Aug. 28, 2002 (JP) ..... 2002-248346

(51) Int. Cl.
*B43K 5/00* (2006.01)
*B43K 8/08* (2006.01)
*B43M 11/06* (2006.01)

(52) U.S. Cl. ..... 401/199; 401/23; 401/198

(58) Field of Classification Search ..... 401/17, 401/23, 196, 198, 199
See application file for complete search history.

(56) References Cited

U.S. PATENT DOCUMENTS 4,065,215 A * 12/1977 Otsuka ..... 401/199
6,322,268 B1 * 11/2001 Kaufmann et al. ..... 401/198
6,659,671 B1 * 12/2003 Fukami et al. ..... 401/198

FOREIGN PATENT DOCUMENTS

| | | |
|---|---|---|
| JP | 35028710 | 10/1960 |
| JP | 53048021 | 11/1978 |
| JP | 59012229 | 4/1984 |
| JP | 60069690 | 5/1985 |

* cited by examiner

*Primary Examiner*—Tuan Nguyen
(74) *Attorney, Agent, or Firm*—Adams & Wilks

(57) ABSTRACT

To provide an applicator which is free from ink leakage under any usage-environmental conditions, is suitable for oil-based ink, maintains appropriate ink delivery and is produced at low cost. The applicator in accordance with this invention is a raw-ink applicator of an automatic delivery type, wherein, with the application body facing downward, an ink flow path on the application body side is arranged on the lower side relative to the ink connecting opening of the ink reservoir while an ink flow path on the ink absorber side and a ventilation annulus are arranged on the upper side relative to the ink connecting opening, the ink absorber is divided into two so that it communicates with the ink in the ink reservoir only in the opening of the ink connection opening, and in the ink flow path the relation, A<B<C, holds, where A represents the density of the rear portion of the flow path on the ink absorber side, B represents the density of the front portion of the flow path on the ink absorber side, and C represents the density the ink flow path on the application body side.

4 Claims, 3 Drawing Sheets

APPLICATOR

TECHNICAL FIELD

This invention relates to an applicator which includes a raw-ink tank for containing a liquid material (hereinafter referred to as ink) such as water-based (water-soluble) or oil-based writing ink for writing utensils, jet printing ink, cosmetic liquid such as eyeliner, or coating liquid such as paint or drug; and a mechanism for automatically controlling the delivery of ink in response to coating, writing or recording.

BACKGROUND OF THE INVENTION

A writing utensil has been known which automatically controls the delivery of raw ink, specifically which includes an ink reservoir in its barrel and replenishes its application body (nib body) with ink contained in the ink reservoir successively with the consumption of ink in writing or coating so that writing or coating can be performed continuously. For example, Japanese Utility Model Publication No. 60-69690 describes a raw-ink delivery controlling mechanism that includes an ink absorber arranged in the ink flow path between the ink reservoir and the tip of the application body in its barrel and flows ink by means of pressure generated by ink movement in capillary (capillary osmotic pressure) which is caused in response to writing, thereby allowing continuous-writing.

In conventional delivery controlling mechanisms of applicators which contain raw ink, an ink absorber is used to absorb the ink over flowing from the raw-ink reservoir mainly to control ink's overflow so that the ink should not drip from the application body etc.

As this type of ink absorber, an ink absorber having a hollow cross section (doughnut-shaped ink absorber) has been generally used and the ink absorber is arranged in parallel or in series with the ink flow path running from the ink reservoir to the application body so that the ink absorber is in contact with the ink flow path throughout its length or at its upper portion only.

In this arrangement, it goes without saying that the length of the ink flow path from the ink reservoir to the tip of the application body is larger than the length of the ink absorber. In such a case, when intending to increase the volume/capacity of the ink absorber while meeting the requirement that an ink absorber of the same material should be installed in a barrel of a prescribed inside diameter, there is no other way but to increase the length of the ink absorber, which in turn requires the length of the ink flow path to be increased.

This gives rise to a problem of the flow of ink fed from the ink reservoir to the application body becoming slow, because it is a general physical phenomenon that the viscosity resistance of ink passing through a small-diameter ink flow path increases as the length of the ink flow path increases. And when intending to increase the diameter of the ink flow path so as to overcome the problem, an adverse effect is produced of decreasing the area in the barrel's inside/transverse section in which the ink absorber is to be installed, thereby relatively decreasing the capacity for absorbing ink, or of making it hard to form the sectional shape of the ink absorber. Thus there remains many difficulties in increasing the capacity of the ink absorber in a raw-ink applicator in which the inside diameter of its barrel is set at a prescribed thickness or in producing an applicator whose ink capacity is large. In addition, there remain other problems in applicators which use such an ink absorber, such as insufficient drip-preventive performance.

The main problems that have caused troubles and therefore having been desired to overcome are as follows.

(1) Generally an ink absorber is installed in such a manner as to be in contact with ink in the ink flow path; as a result, it absorbs of itself ink in the ink reservoir even under normal storage and it is easy to fill with ink to almost saturated state. If gas expansion takes place in the barrel under these conditions due to environmental changes and ink is pushed out from the ink reservoir, ink drips from the application body since the capability of the ink absorber to absorb the overflowing ink is insufficient.

(2) In the usage environment, since pressure or temperature changes take place repeatedly, gas in the ink reservoir repeats its contraction/expansion. Accordingly, even if the ink absorber can absorb the ink pushed out from the ink reservoir at the time of gas expansion, the absorbed ink can sometimes remain in the ink absorber, and the absorber cannot be restored to the state before absorption even at the time of gas contraction. In such a case, the same problem as (1) arises.

(3) When producing a product having a large ink capacity or a product which is filled with ink having a high vapor pressure, such as oil-based ink, the change in gas expansion in the ink reservoir is increased. In such a case, when removing the cap fitted on the barrel to close the same, for example, the gas in the barrel expands so promptly that the ink absorber cannot absorb and hold the ink, resulting in occurrence of the drip of ink.

DISCLOSURE OF THE INVENTION

This invention has been made in the light of the above described problems. Accordingly, an object of this invention is to provide an applicator which hardly causes ink leakage such as ink drip under various usage or storage environmental conditions, even when using not only water-based ink but also oil-based ink, and which is of high quality enough to maintain appropriate ink delivery even when writing is carried out at high speeds.

Another object of this invention is to provide an applicator which can remove troubles such as thin spots caused by insufficient feeding of ink from the ink reservoir to the application body (nib body), which temporarily occur in continuous writing when pursuing the solution to the above problems.

One aspect of this invention is an applicator of an automatic delivery type comprising a raw-ink reservoir allowing the internal flow of ink filled therein; an ink absorber for controlling the overflow of ink in the ink reservoir; and an application body for applying ink, with an ink flow path for introducing ink in the ink reservoir branched out into two flow path, an ink flow path on the application body side and an ink flow path on the ink absorber side, wherein, with the application body facing downward, an application body's flow tube whose inside is the ink flow path on the application body side is arranged on the lower side relative to the ink connecting opening, as an exit of the ink flow path, of the ink reservoir while a double tube consisting of an inner tube whose inside is the ink flow path on the ink absorber side; and an outer tube for ventilation is arranged on the upper side relative to the ink connecting opening, in the inside of the inner tube the ink absorber being arranged and an air intake/exhaust annulus being formed, the air intake/exhaust annulus being connected to an outside air opening which is connected to the outside circumference of the application body via the outer tube for ventilation by a roundabout way, the ink absorber being divided so that it communicates with ink in the ink reservoir only in the ink connecting opening, in the opening of the ink connecting opening a portion with strong capillary action and a portion with weak capillary action being formed in such a manner as to provide the opening with a shape by decreasing the area of the transverse cross section from the outside circumference side toward the inside circumference side or to provide the inner wall of the opening an irregular portion that forms a wide clearance portion and a narrow clearance portion, and in the ink flow path the relation, A<B<C, holding, where A represents the density (or capillary force) of the ink absorber in the large-diameter portion of the inner tube, which is the rear portion of the flow path on the ink absorber side, B represents the density (or capillary force) of the capillary member arranged in the small-diameter portion of the inner tube, which is the front portion of the flow path on the ink absorber side, and C represents the density (or capillary force) of the capillary member arranged in the application body's flow tube, which is the ink flow path on the application body side.

The applicator in accordance with this invention has overcome the above described problems by (1) allowing the ink absorber to absorb ink in the ink reservoir of itself to thereby prevent the ink reservoir from being brought to the absorption saturation state and (2) providing the repeated action of returning to the ink reservoir the ink that is absorbed by the ink absorber in the contraction/expansion changes occurring in the ink reservoir. Specifically, the action of the applicator in accordance with this invention is as follows.

In contrast to the above mentioned usage of conventional ink absorbers, the ink absorber of this invention (ink flow path on the ink absorber side) is thought out to allow the ink overflowing from the ink reservoir to be absorbed from the lower portion of the ink absorber toward the upper portion of the same via the ink connecting opening, thereby producing the preferable function/action as described above. The reasons of the preferable function/action are as follows.

(1) In the construction of the applicator in accordance with this invention, the application body's flow tube portion as the ink flow path on the application body side is provided on the front side of the applicator where the ink absorber does not exist in the same cross-sectional plane. As a result, the formation of the ink flow path leading to the tip of the application body is not affected by the ink absorber. This makes possible a short and thick flow path, as a result, the ink flowing from the ink reservoir to the tip of the application body undergoes less resistance and the ink delivery is increased.

(2) In the construction of the applicator in accordance with this invention, the inside of the inner tube on the upper side relative to the ink connecting opening is used as the ink flow path on the ink absorber side while arranging the ink absorber and forming an air intake/exhaust annulus in the inside. Such a construction is thought out to facilitate the discharge of air in the ink absorber and allow the ink overflowing from the ink reservoir to be absorbed in the ink absorber quickly.

This enhances the ink absorber's action on the ink, which the absorber absorbed once when it overflowed from the ink reservoir, to return the ink to the ink reservoir via the ink connecting opening when the overflowing of ink due to the gas expansion in the ink reservoir is settled, the gas begins to contract and the pressure in the ink reservoir is reduced.

In other words, when the ink reservoir is brought to the depressurized state, outside air flow is produced from the outside air opening connected to the above described outside circumference of the application body toward the ink connecting opening via the air intake/exhaust annulus on the side surface of the ink absorber. At this point the ink absorber is filled with a large amount of ink pushed out from the ink reservoir and thus the absorbed ink need to be returned to the ink reservoir before outside air is absorbed in the ink reservoir. To obtain such action, the ink absorber is arranged on the upper side relative to the ink connecting opening.

In short, when the application body is kept facing downward, ink absorbed in the ink absorber tends to accumulate in the ink connecting opening downward by gravity and therefore the phenomenon is less likely to occur that air, which is light-weight compared with ink, is absorbed in the ink reservoir before ink. Thus a state where ink is absorbed effectively in the ink reservoir is produced.

(3) In the construction of the applicator in accordance with this invention, the flow of the ink overflowing from the ink reservoir branches out into two: the ink absorber side flow and the application body side flow so that, when the inside of the ink reservoir expands significantly, the ink which the ink absorber cannot absorb can overflow and join the tip of the application body through the space on the side surface of the application body via the ventilation annulus connected to the outside air opening by a roundabout way.

In this construction, the outside air opening, which allows the outside and the inside of the applicator to communicate with each other, is formed only in the side surface of the application body of the tip of the front barrel; as a result, the flow of ink and air going outside can be stopped easily just by closing the outside air opening with a cap attached on the front barrel, and at the same time, even if the ink overflowing from the ink reservoir accumulates on the side surface of the application body, once the expansion of the ink reservoir is settled and the inside of the ink reservoir is being depressurized, the ink accumulating on the side surface of the application body is absorbed by and returned to the ink reservoir through the application body.

The construction of the applicator in accordance with this invention described so far produces preferable effects as described above. However, the construction is still insufficient in that its ink absorber has a tendency to absorb ink from the ink reservoir and be filled with the ink under the condition that the ink absorber is left unused for a substantial period of time. Thus, to overcome the insufficiency is thought out a construction in which the relation, A<B<C, holds, where "A" represents the density (or capillary force) of the ink absorber in the large-diameter portion of the inner tube, which is the rear portion of the flow path on the ink absorber side, "B" represents the density (or capillary force) of the capillary member arranged in the small-diameter portion of the inner tube, which is the front portion of the flow path on the ink absorber side, and "C" represents the density (or capillary force) of capillary member arranged in the application body's flow tube, which is the ink flow path on the application body side.

The action of such a construction will be described below. The ink absorber absorbs of itself ink in the ink reservoir, which is connected to the ink absorber via the ink connecting opening, when the ink reservoir absorbs outside air in an amount equivalent to that of the ink which the ink absorber absorbs (that is, air exchange is made). Thus, in order to control such air movement and inhibit the ink absorber from absorbing air of itself and being filled with air, the construction is thought out in which the above relation (A<B<C) holds.

Specifically, by allowing the density (or capillary force) B of the ink absorber as the capillary member in the small-diameter portion of the inner tube (the front portion of the inner tube) to be higher than the density (or capillary force) A of the ink absorber as the capillary member in the large-diameter portion of the inner tube (the rear portion of the inner tube), strong capillary force acts locally on the neighborhood of the portion of the ink absorber having a density B and keeps the portion in the fluid seal state where ink is accumulated. Thus, when the portion of the ink absorber where capillary action is relatively low is intended to absorb the ink in the ink reservoir, the above fluid seal state inhibits the outside air, which tends to enter the ink reservoir, from being absorbed in the ink reservoir, thereby inhibiting the ink absorber from being filled with ink and keeping the same unfilled state.

The fluid seal action of blocking the air absorption is operatively connected with the ink absorption by and ink's movement to the portion of application body having a density C, where capillary action is much higher and consumption of ink is large. The blocking action is dissolved or removed by depressurizing the inside of the ink reservoir, and once it is removed, the outside air is allowed to pass through the ink reservoir, thereby enabling a continuous writing operation.

The action described above makes it possible to keep the ink absorber in the unfilled state, which allows the ink absorber to absorb ink, for a long period of time and prepare for the irregular overflow of ink under normal storage or under various usage environmental conditions.

Specifically, when ink is forced to overflow from the ink reservoir in the applicator of this invention under usage due to, for example, air expansion in the ink reservoir, the overflowing ink tends to flow toward the ink flow path on the application body side and toward the ink flow path on the ink absorber side via the ink connecting opening. However, the ink flow path on the application body side has the highest density (C) and is highly resistant to the ink flow, whereas the ink absorber has space not filled with ink and its side surface has the air intake/exhaust annulus connecting to the outside and thus allows a smooth discharge of air. As a result, ink flows in the ink absorber preferentially, which prevents the drip (excessive flow or "gobbing") of ink from the application body.

When the air in the expanded state in the ink reservoir is contracted and restored to the original state, since the ink flow path on the application body side has a high density and a strong capillary force, outside air is inhibited from being taken into the ink reservoir from this side, the ink absorbed in the ink absorber is absorbed back in the ink reservoir through the ink flow path on the ink absorber side, whereby the ink-absorbing capability of the ink absorber is restored again. Thus, ink leakage is prevented even in the environment where gas contraction/expansion is repeated in the ink reservoir.

BEST MODE FOR CARRYING OUT THE INVENTION

In the following this invention will be described in detail with reference to the accompanying drawings.

EXAMPLE 1

Figure 1:
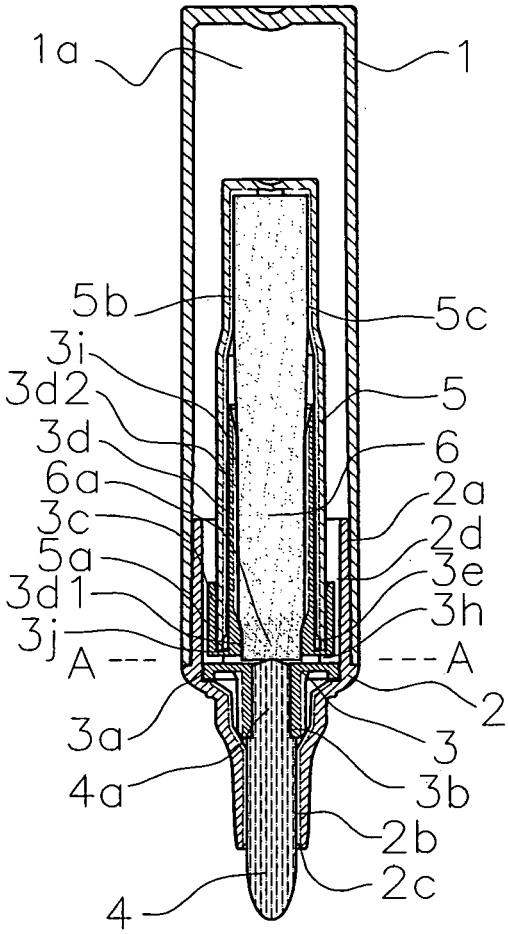
FIG. 1 is a longitudinal sectional view of an applicator in accordance with example 1 of this invention.
Figure 2:
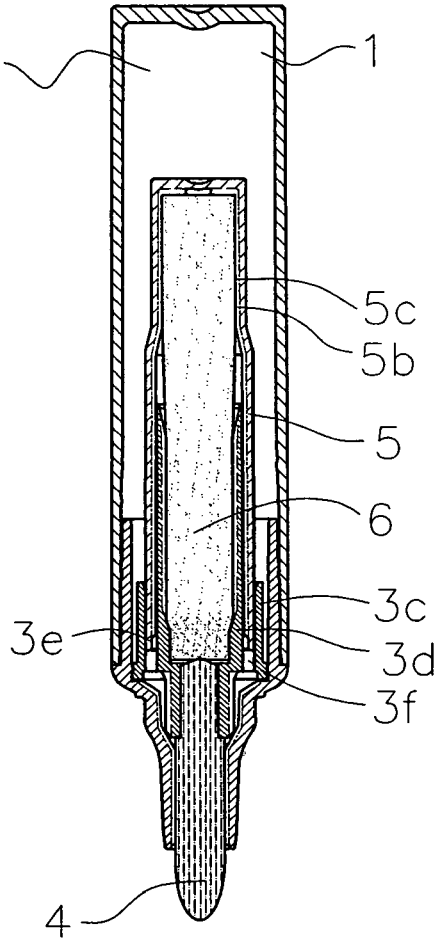
FIG. 2 is a longitudinal sectional view of the applicator of FIG. 1, when it is rotated about its axis by 90 degrees.
Figure 3:
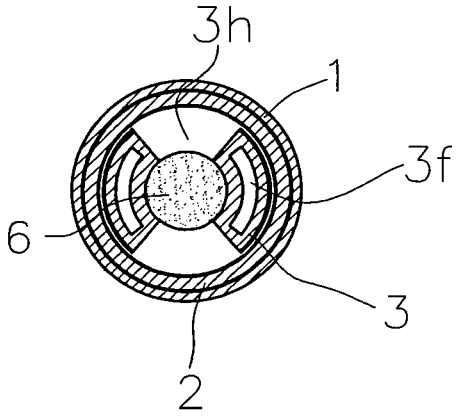
FIG. 3 is a transverse sectional view taken along the line A—A of FIG. 1.
Figure 4:
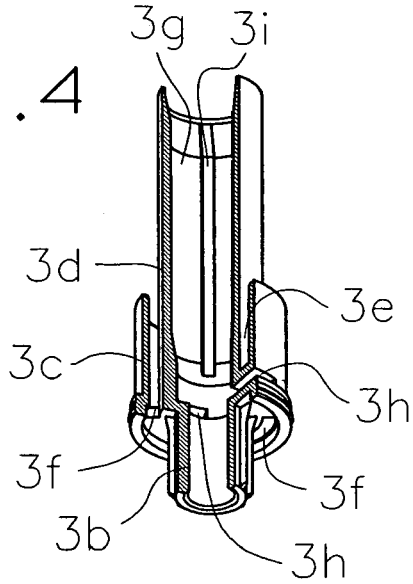
FIG. 4 is a perspective view showing the main part of the applicator of example 1.

FIGS. 1–4 show an applicator in accordance with example 1 of this invention. FIG. 1 is a longitudinal sectional view of the applicator in accordance with example 1, FIG. 2 is a view of the applicator of FIG. 1, when it is rotated about its axis by 90 degrees, FIG. 3 is an enlarged transverse sectional view taken along the line A—A of FIG. 1, and FIG. 4 is a perspective view of the joint member of example 1. Reference numeral 1 denotes a rear barrel whose rear end portion is closed to use its interior as an ink reservoir 1*a* and fill the same with ink and whose front end portion is close fitted on the outside circumference portion 2*a* of a front barrel 2.

The front barrel 2 is closely fitted on the partition flange portion 3*a* of a joint tube 3 in the inside circumference portion, which will be described in detail presently, to divide itself into two: a rear barrel portion as an ink reservoir; and a front barrel portion as an attachment portion to which an applicator body 4 is attached. The application body 4 is attached to the inside of the front barrel 2 in such a manner as to provide a longitudinal rib 2*b* to the inside circumference of the front barrel 2 to press and fix the outside circumference portion of the application body 4 in the front barrel 2. Thus an outside air opening 2*c* is formed and the inside of the barrel is in communication with the outside air.

The above described joint tube 3 includes the following constituents. The joint tube 3 includes an applicator passing tube 3*b*, a single tube, which is provided on the front side relative to the partition flange portion 3*a* in such a manner as to be connected with the partition flange portion 3*a*. In the applicator passing tube 3*b* the rear portion 4*a* of the application body 4 is pressed so as to provide an ink flow path on the application body side. The joint tube 3 also includes a double tube consisting of an outer tube 3*c* and an inner tube 3*d* for ventilation which is provided on the rear side relative to the partition flange portion 3*a* in such a manner as to be connected with the partition flange portion 3*a*. In the inner tube 3*d* an ink absorber 6 is arranged so as to provide an ink flow path on the ink absorber side. A ventilation annulus 3*e* is formed between the outer tube 3*c* and the inner tube 3*d*. To the inside circumference portion of the outer tube 3*c* is closely fitted the outside circumference of the front portion 5*a* of an absorber protective tube 5 whose rear end is closed so as to house the ink absorber 6 arranged in the inner tube 3*d* and divide the ink absorber 6 from the raw ink filled in the ink reservoir 1*a*.

On the inner wall of the absorber protective tube 5, a plurality of longitudinal ribs 5*b* for fixing the outside circumference portion of the ink absorber 6 in the inside of the absorber protective tube 5 are provided to form an air intake/exhaust annulus 5*c*, between the outside circumference portion of the ink absorber 6 and the absorber protective tube 5, as a vent line which connects the interior of the barrel to the outside air. The air intake/exhaust annulus 5*c* is in communication with the ventilation annulus 3*e* formed between the outer tube 3*c* and the inner tube 3*d*, the ventilation annulus 3*e* is in communication with the outside of the applicator passing tube 3*b* in the front barrel 2 through a ventilation annulus hole 3*f* which is formed through the transverse cross section of the partition flange portion 3*a*, and the interior of the front barrel 2 is in communication with the outside air through the outside air opening 2*c*.

The inside of the applicator passing tube 3*b* is in communication with the front portion of the inner tube 3*d* in the ink flow path on the ink absorber side. The diameter of the inner tube 3*d* axially varies so that its front portion is a small-diameter portion 3*d*1 and its rear portion is a large-diameter portion 3*d*2 and the inner wall of the inner tube 3*d* is provided with longitudinal ribs 3*i* which reach the rear end of the inner tube. Accordingly, the diameter of the ink absorber 6, which is arranged in the inner tube 3*d*, is compressed in the small-diameter portion 3*d*1. And in the large-diameter portion 3*d*2 is formed an air intake/exhaust annulus 3*g* which is surrounded by the inner wall of the inner tube 3*d* between the longitudinal ribs 3*i* and the outer wall of the ink absorber 6. The air intake/exhaust annulus 3*g* is in communication with the inside of the absorber protective tube 5 and is also connected to and in communication with the above described ventilation annulus 3*e* by a round about way.

In the outer tube 3*c* which is connected to the rear portion side relative to the above described partition flange 3*a* is formed an opening, that is, an ink connecting opening 3*h* which leads to the inside of the inner tube 3*d* from the outside circumference portion of the outer tube 3*c*.

The ink connecting opening 3*h* is a penetration which connects the outside circumference portion of the outer tube 3*c* and the inner tube 3*d* radially by a partition wall 3*j* which blocks part of the cross section of the ventilation annulus 3*e*. The raw ink coming in contact with the outer tube 3*c* is in communication with the inside of the inner tube 3*d*, while avoiding coming in contact with the ventilation annulus 3*e*, by the ink connecting opening 3*h*. Accordingly, the raw ink filled into the ink reservoir 1*a* is in communication with the inside of the inner tube 3*d* only through the inside of the ink connecting opening 3*h* formed in the outer tube 3*c*.

In the inside of the inner tube 3*d*, the ink absorber 6 is loaded with its front portion compressed by the small-diameter portion 3*d*1 and reaching the above described ink connecting opening 3*h* so as to come in contact with the ink. On the other hand, the rear portion 4*a* of the application body, which is inserted into the application body's flow tube 3*b*, also reaches the ink connecting opening 3*h*. As a result, the raw ink filled in the rear barrel 1 flows through an ink flow path 2*d* and branches out into two sides and comes in contact with the rear portion of the application body 4*a*, the front side, and the ink absorber 6, the rear side.

As the above described ink absorber 6 is applicable any one of the absorbers having been used in publicly known writing utensils; however, preferably used are those made of materials whose density can be increased when they are inserted into the above described inner tube 3*d* and compressed radially. Such materials usable for absorbers include, for example, porous material/foamed materials such as what is called bat wool, which is made by converging synthetic fibers such as polyester, acrylic, polyolefin, acetate, nylon and polyurethane, sintered body and foamed sponge.

In this example, as the ink absorber can be used those whose cross section is circular or polygonal, other than those whose cross section has a hollow (whose cross section is doughnut-shaped) which have been used in common raw-ink writing utensils. This means ink absorbers whose manufacturing and processing are easy and whose costs are low can be used in this example. As the application body 4, nib bodies which have the capillary action and have been used in common writing utensils are applicable. Specifically, an applicator in accordance with this invention can be completed using a core material of converged fibers, felt, a porous nib material such as sintered body or foamed body, a formed core material with a capillary channel formed in its cross section, a ball point pen tip, or a metal nib with a capillary slit formed on its cross section.

In the ink flow path of this example, it is necessary that the following relation, A<B<C, holds, where A represents the density (or capillary force) of the ink absorber 6 in the large-diameter portion 3*d*2 of the inner tube, which is the rear portion of the flow path on the ink absorber side, B represents the density (or capillary force) of the compressed portion 6*a* of the ink absorber in the small-diameter portion. 3*d*1 of the inner tube, which is the front portion of the flow path on the ink absorber side, and C represents the density (or capillary force) of the rear portion 4*a* of the application body in the application body's flow tube, which is the ink flow path on the application body side.

The applicator of this example having a constitution described above shows the following function/action. The raw ink filled in the inside of the rear barrel 1 flows through the ink flow path 2*d* and comes in contact with, via the inside of the ink connecting opening 3*h*, the rear portion 4*a* of the applicator pressed and fixed in the application body's flow tube 3*b* and the compressed portion 6*a* of the ink absorber loaded in and compressed by the small-diameter portion 3*d*1 of the front portion of the inner tube 3*d*. As a result, the ink can be supplied directly from the ink connecting opening 3*h* to the tip of application body 4, and moreover, the rear portion 4*a* of the application body 4 attached can be thick, whereby the ink delivery performance of the applicator is good.

Air existing in the inside of the ink absorber 6 is in communication with the ventilation annulus 3*e* from the air intake/exhaust annulus 3*g* on the outside circumference portion by a round about way, connected to the inside of the front barrel through the ventilation annulus hole 3*f*, and in communication with the outside air at the outside air opening 2*c*. Thus, the air intake/exhaust can be performed smoothly and the ink absorber 6 has good ink absorbing/holding performance.

If the ink absorber 6 absorbs ink spontaneously from the ink connecting opening 3*h*, the ink absorber 6 will be filled with ink. However, in this example, the ink absorber 6 is so constructed that its density is high at the small-diameter portion 3*d*1 of the inner tube because it is compressed there (that is, B) and the density of its rear portion is relatively low because the rear portion is not compressed (that is, A) and thus the absorber is kept in such a state that in the portion at the small-diameter portion 3*d*1, whose density is high, a strong capillary force acts locally and ink is infiltrated and filled into the portion while in the rear portion, whose density is low, ink is hard to infiltrate. Specifically, to allow the ink absorber 6 to draw out the ink in the ink reservoir 1*a*, it is necessary for the ink reservoir 1*a* to absorb the outside air in the same amount as that of the ink which the ink absorber is to absorb; accordingly, even if the ink absorber 6 is intended to absorb the ink in contact with the ink connecting opening 3*h*, it cannot absorb the ink unless the ink reservoir 1*a* absorbs such amount of outside air. In other words, the portion of the ink absorber 6 in the small-diameter portion 3*dl* absorbs the ink with a strong capillary force (B); as a result, even if the portion of the ink absorber in the large-diameter portion 3*d*2, whose capillary force is weak (A), is intended to absorb the ink, it is hard for the portion to absorb the ink, since the passage of the outside air is inhibited in the small-diameter portion 3*d*1. Thus, it is hard for many capillary vacant spaces distributed in the ink absorber 6 to absorb the ink even if they are in condition where they have an ink-absorbing capability.

On the other hand, the capillary force (C) of the rear portion 4*a* of the application body is kept stronger than the capillary force (B) of the portion of the ink absorber, which is compressed in small-diameter portion 3*d*1; accordingly, when writing is performed with the application body 4, ink is smoothly supplied from the ink connecting opening 3*h*. Since the pressure in the inside of the ink reservoir 1*a* is reduced in response to the ink consumption, the outside air is absorbed in the small-diameter portion 3*d*1 through the air intake/exhaust annulus 3*g*, thereby making possible automatically controlled continuous writing. When ink is consumed as the progress of writing and the amount of outside air absorbed in the ink reservoir 1*a* is increased, if temperature change takes place, the amount of gas expansion is physically increased.

In this example, when ink is pushed out from the ink reservoir 1*a* due to the gas expansion in the same, the flow of the overflowing ink branches out into the ink absorber (the small-diameter portion of the inner tube) and the application body (the inside of the application body's flow tube) through the ink connecting opening 3*h*. At this point, in the application body, the resistance to the passage of ink is high since the application body (the inside of the application body's flow tube 3*b*) has a high density and a narrow flow path compared with the ink absorber (the inside of the small-diameter portion 3*d*1). On the other hand, in the ink absorber, since the large-diameter portion 3*d*2 has many capillary portions not having absorbed ink yet and has good air-exhaust properties, the resistance to the passage of ink is lower than that of the application body and it is kept in state where the overflowing ink is easy to absorb. Thus the ink absorber quickly absorbs ink, thereby preventing ink from dripping or excessively flowing from the tip of the application body.

When temperature change does not take place any longer and expanded air in the ink reservoir 1*a* begins to contract, in the ink flow path on the application body side, the capillary force is strong and therefore it is hard for the outside air to pass through the ink flow path. On the other hand, in the ink flow path on the ink absorber side, the capillary force is relatively weak and therefore ink absorbed in the ink absorber is concentrated in the small-diameter portion 3*d*1 of the inner tube and absorbed back to the ink reservoir 1*a* through the ink connecting opening 3*h*. Thus, the ink absorber 6 has an increased number of capillary portions not having absorbed ink and can be prepared for the next expansion. In other words, the applicator of this example acts preferably as an applicator that can cope with the continuous expansion and contraction of air in the ink reservoir 1*a*. When ink cannot be absorbed in the ink absorber 6, for example, when air expansion in the ink reservoir 1*a* takes place too drastically, the ink will overflow and flow out in the application body 4 in the front barrel 2; however, in this example, the path leading to the outside is limited to that of the circumference portion of the application body, ink can be prevented from dripping just by ordinary means, such as closing the outside circumference portion of the front barrel with a cap.

Even if ink is accumulated temporarily in the front barrel 2, since the ink flow path of this example is so constructed that it easily absorbs ink in contact with the application body 4 from the application body 4 when the air in the ink reservoir 1*a* contracts and brings the ink reservoir 1*a* to the depressurized state, dripping can be prevented. Thus, this example provides a very preferable applicator whose drip-preventive function is highly reliable, ink-delivery performance is good, and whose design makes it easy to attach a large ink absorber and allows a large amount of ink to be filled in the applicator.

EXAMPLE 2

Figure 5:
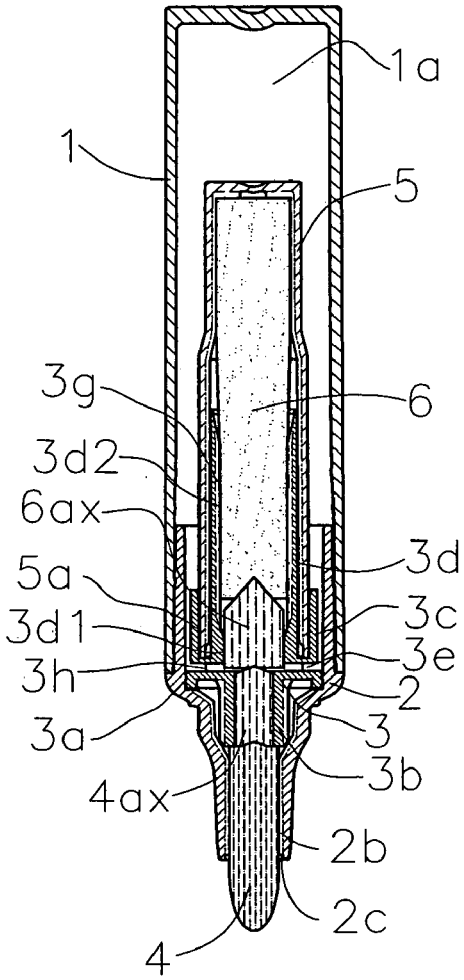
FIG. 5 is a longitudinal sectional view of an applicator in accordance with example 2 of this invention.

An applicator in accordance with example 2 of this invention is shown in FIG. 5, which is a longitudinal sectional view of the applicator in accordance with this example. The applicator of example 2 is the same as that of example 1, except that part of the materials used for the ink flow path is changed. The function/action obtained are the same as those of example 1; however, this example is shown by way of example that provides a wider choice when manufacturing applicators, in particular, provides, for example, improved dimensional precision with which materials used for parts are processed and improved capillary force (or density) precision. Parts that are in common with those of example 1 are denoted with the same reference numerals.

In a rear barrel 1, its rear end portion is closed to use its interior as an ink reservoir 1*a* and fill the same with ink and its front end portion is close fitted on a front barrel 2. The front barrel 2 is closely fitted on the partition flange portion 3*a* of a joint tube 3 in its circumference portion to divide itself into two: a rear barrel portion as an ink reservoir; and a front barrel portion as an attachment portion to which an applicator body 4 is attached. The application body 4 is attached to the inside of the front barrel 2 in such a manner as to provide a longitudinal rib 2*b* to the inside circumference of the front barrel 2 to press and fix the outside circumference portion of the application body 4 in the front barrel 2. Thus, an outside air opening 2*c* is formed and the inside of the barrel is in communication with the outside air.

The above described joint tube 3 includes an applicator passing tube 3*b*, a single tube, which is provided on the front side relative to the partition flange portion 3*a* in such a manner as to be connected with the partition flange portion 3*a*. In the applicator passing tube 3*b* a junction capillary body 4*ax* is inserted so as to provide an ink flow path on the application body side. The junction capillary body 4*ax* is in contact with the rear portion of the above described application body 4. The rear side of the joint tube 3 is connected with a double tube consisting of an outer tube 3*c* and an inner tube 3*d*. In the opening of the front portion of the inner tube 3*d*, an ink-infiltration body 6*ax* is inserted and fixed to provide an ink flow path on the ink absorber side. A ventilation annulus 3*e* is formed between the outer tube 3*c* and the inner tube 3*d*. To the inside circumference portion of the outer tube 3*c* is closely fitted the outside circumference of the front portion 5*a* of an absorber protective tube 5 whose rear end is closed so as to house the ink absorber 6 arranged in the inner tube 3*d* and divide the ink absorber 6 from the raw ink filled in the ink reservoir 1*a*. The construction of a vent line for ventilating the inside of the barrel with the outside is the same as that of example 1 described above.

The inside of the application body's flow tube 3*b* is in communication with the inside of the front portion of the inner tube 3*d*, and in the small-diameter opening 3*dl* the above described ink-infiltration body 6*ax*, whose capillary force is stronger than that of the ink absorber, is loaded and fixed. The diameter of the inner tube 3*d* axially varies so that its front portion is a small-diameter portion 3*d*1 and its rear portion is a large-diameter portion 3*d*2 and the inner wall of the inner tube 3*d* is provided with longitudinal ribs 3*i* which reach the rear end of the inner tube. Accordingly, in the large-diameter portion 3*d*2 of the rear portion of the inner tube 3*d*, other than the small-diameter portion 3*d*1 of the front portion of the same, is formed an air intake/exhaust annulus 3*g* which is surrounded by the inner wall of the inner tube 3*d* between the longitudinal ribs 3*i* and the outer wall of the ink absorber 6. The air intake/exhaust annulus 3*g* is in communication with the inside of the absorber protective tube 5 and is also connected to and in communication with the above described ventilation annulus 3*e* in a roundabout way.

In the outer tube 3*c*, an ink connecting opening 3*h* which leads to the inside of the inner tube 3*d* from the outside circumference portion of the outer tube 3*c*. The ink connecting opening 3*h* is a penetration which connects the outside circumference portion of the outer tube 3*c* for ventilation and the inner tube 3*d* radially by a partition wall 3*j* which blocks part of the cross section of the ventilation annulus 3*e*. Accordingly, the raw ink in contact with the outer tube 3*c* is in communication with the inside of the inner tube 3*d* by the ink connecting opening 3*h*, while avoiding coming into contact with the ventilation annulus 3*e*.

The raw ink filled into the ink reservoir 1*a* is in communication with the inside of the inner tube 3*d* only through the inside of the ink connecting opening 3*h* formed in the outer tube 3*c*. In the inside of the inner tube 3*d*, the front portion of the ink-infiltration body 6*ax* having been loaded and fixed in the small-diameter portion 3*d*1 of its front portion reaches the above-described ink connecting opening 3*h* to come in contact with ink while its rear portion is connected to the ink absorber in the rear.

On the other hand, the junction capillary body 4*ax* having been inserted in the application body's flow tube 3*b* in the front also reaches the ink connecting opening 3*h*. Accordingly, the raw ink filled in the rear barrel flows through the ink flow path 2*d* to the ink connecting opening 3*h* where it branches out into two: one coming in contact with the junction capillary body 4*ax* in the front; and the other coming in contact with the ink-infiltration body 6*ax* in the rear.

As the materials used for the ink absorber 6 and the application body 4, the same materials as those of example 1 can be employed. As the materials for the junction capillary body 4*ax* and the ink-infiltration body 6*ax*, those which produce less variations in the formation of capillary vacant spaces, ensure dimensional precision in the processing and are sufficiently elastic can be properly selected from among various materials such as core materials of converged resin-curing fibers which are made by converging known synthetic fibers and solidifying by the resin hardener, felt, porous materials (sintered body, foamed body, etc.) and formed core materials with a capillary channel formed in their cross section.

In the ink flow path of this example, it is necessary that the following relation, A<B<C, holds, where "A" represents the density (or capillary force) of the ink absorber 6 in the large-diameter portion 3*d*2 of the inner tube, which is the rear portion of the flow path on the ink absorber side, "B" represents the density (or capillary force) of the ink-infiltration body 6*ax* in the small-diameter portion 3*dl* of the inner tube, which is the front portion of the flow path on the ink absorber side, and "C" represents the density (or capillary force) of the junction capillary body 4*ax* in the application body's flow tube, which is the ink flow path on the application body side. The applicator of this example thus constructed has the same function/action as those shown in example 1.

The applicator of this example, where a junction capillary body 4*ax* is used in the application body's flow tube 3*b* as an ink flow path on the application body side, is preferable to that of example 1, where the rear portion of the application body is directly used, when the material used for the application body makes the capillary force in the application body non-uniform, specifically when the material is a core material of converged resin-curing fibers with hard surface and soft inside, that is, with inside and outside in different capillary forming states. The applicator of this example is also preferable to that of example 1, when the material used for the ink absorber is likely to create variations in quality when the ink absorber is compressed.

EXAMPLE 3

Figure 6:
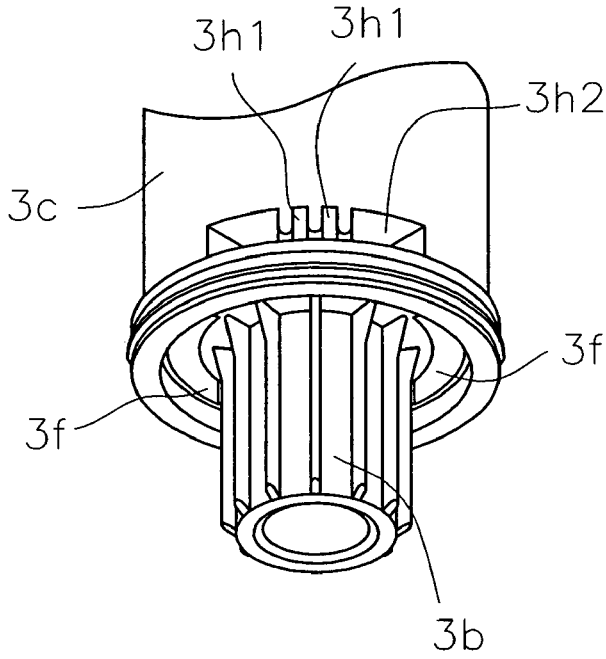
FIG. 6 is an enlarged view showing the main part of a joint tube in accordance with example 3 of this invention.
Figure 7:
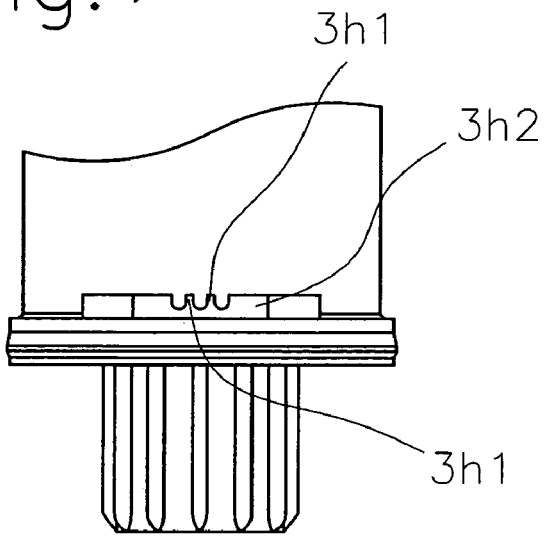
FIG. 7 is an enlarged front view of the joint tube in accordance with example 3 shown in FIG. 6.

A joint tube in accordance with example 3 of this invention is shown in FIG. 6, which is an enlarged view showing the main part of the joint tube in accordance with example 3. The ink connecting opening 3*h* is a penetration which connects the outside circumference portion of the outer tube 3*c* and the inner tube 3*d* radially by a partition wall 3*j* which blocks part of the cross section of the ventilation annulus 3*e*. AS shown in FIGS. 6 and 7, the shape of the opening is such that irregular ribs with concavo-convex portions are formed on the middle upper portion of the opening wall, the convex portion 3*h*1 of the ribs is provided with a narrow clearance while the concave portion 3*h*2 of the same with a wide clearance so that the capillary action is strong in the convex portion 3*h*1 while the capillary action weak in the concave portion 3*h*2, and the size of the outermost part of the ink connecting opening 3*h* is large in the periphery and gradually decreased towards the inner part of the ink connecting opening 3*h*. The ink connecting opening 3*h* provided with such a shape produces the following effects.

When air bubbles of the outside air which are taken into during continuous writing are accumulated in the ink connecting portion 3*h* etc., the flow of ink is inhibited in the ink reservoir and the rear portion of the application body, and this will cause blur in writing. However, since the ink connecting opening 3*h* of this example is formed to have a concave portion 3*h*2 whose clearance is wide (the portion whose capillary action is weak) and a convex portion 3*h*1 whose clearance is narrow (the portion whose capillary action is strong), air is hard to accumulate in the portion whose capillary action is strong, whereby ink is constantly supplied to the rear portion of the application body and the ink delivery performance in continuous writing is kept stable.

EXAMPLE 4

Figure 8:
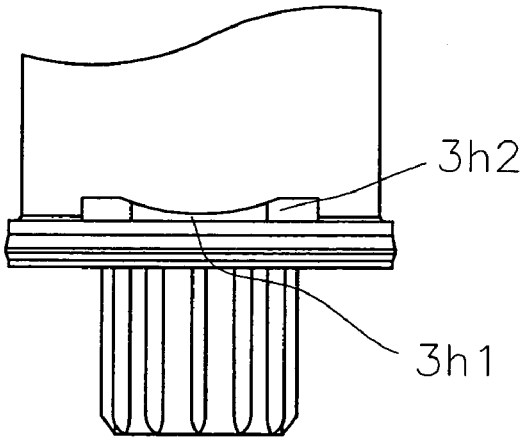
FIG. 8 is an enlarged front view showing the opening shape of the ink connecting opening of a joint tube in accordance with example 4 of this invention.

A joint tube in accordance with example 4 of this invention is shown in FIG. 8. FIG. 8 is an enlarged front view showing the opening shape of the ink connecting opening of the joint tube in accordance with this example. The joint tube of example 4 is the same as that of example 3, except that the opening shape of the ink connecting opening is changed. When changing the opening shape of the ink connecting opening, if a portion with narrow clearance (narrow portion 3*h*1), on which capillary action acts strong, and a portion with wide clearance (wide portion 3*h*2), on which capillary action acts weakly, are formed in the opening through which the outside circumference of the ink connecting opening and the inside circumference of the same are in communication with each other, air bubbles are hard to accumulate in the opening during continuous writing, which produce the same function/action as those of example 3. This example is shown by way of example that provides a wider choice of manufacturing parts related to the opening.

Depending on the situation, the cross section can have a plurality of ink connecting openings throughout its plane, and in that case, too, the same action/function can be obtained.

EXAMPLE 5

Figure 9:
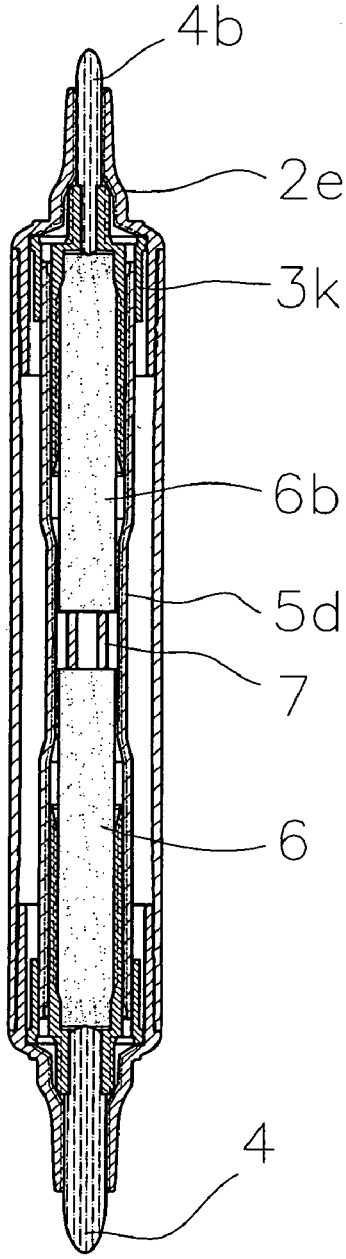
FIG. 9 a longitudinal sectional view of an applicator in accordance with example 5 of this invention.

An applicator in accordance with example 5 of this invention is shown in FIG. 9. FIG. 9 is a longitudinal sectional view of the applicator of this example. This example is a twin-type applicator which uses the construction described so far and further arranges an upper-side front barrel 2*e*, an upper-side joint tube 3*k* and an upper-side application body 4*b* on the upper portion of its rear barrel 1. An ink absorber protective tube 5*d* is used as a tube which connects the upper side and the lower side to each other. A lower-side ink absorber 6 and an upper-side ink absorber 6*b* are arranged in the absorber protective tube 5*d* and an ink absorber partition 7 is provided between the two ink absorbers. Arranging the ink absorber partition 7 facilitates the ingress of air to both ink absorbers from the sides apart from the application bodies 4/4*b*, which enables a smooth movement of ink in both ink absorbers.

Although a twin-type applicator is shown in FIG. 9 in which an ink absorber protective tube 5 is formed as one part that penetrates through the upper side and lower side, the ink absorber protective tubes 5 just like those of examples 1 to 4 may be formed separately for the upper side use and for the lower side use. Further, when using sponge or a fiber bundle not coated with a film or the like, which allows air to enter from the side surface, as a material for the ink absorber 6, even if the upper-side and lower-side ink absorbers are integrally formed into one ink absorber, air can enter the ink absorber of a unitary structure; thus, it becomes unnecessary to use an ink absorber partition 7 to divide the ink absorber into two.

INDUSTRIAL APPLICABILITY

According to this invention, the problems as described above can be solved due to its construction and action, and a raw-ink applicator having a sufficient ink-delivery performance and highly reliable dip-preventive function can be provided using low cost members.

According to this invention, it is possible to fill the ink reservoir almost to the brim with ink at the time of assembling a product, while filling the ink absorber with ink in advance. Filling both the ink reservoir and the ink absorber with ink makes it possible to provide a raw-ink applicator in which an increased amount of ink is filled compared with conventional ones.

What is claimed is:

1. An applicator of an automatic delivery type comprising a raw-ink reservoir allowing the internal flow of ink filled therein; an ink absorber for controlling the excessive flow of ink in the ink reservoir; and an application body for applying ink with an ink flow path for introducing the ink in the ink reservoir branched out into two flow paths, an ink flow path on the application body side, and an ink flow path on the ink absorber side, wherein, with the application body facing downward, an application body's flow tube whose inside is used as an ink flow path on the application body side is arranged on the lower side relative to an ink connecting opening, as an exit of the ink flow path, of the ink reservoir, while a double tube consisting of an inner tube whose inside is used as an ink flow path on the ink absorber side and an outer tube for ventilation is arranged on the upper side relative to the ink connecting opening, wherein:

in the inside of the inner tube the ink absorber is arranged and an air intake/exhaust annulus is formed, the air intake/exhaust annulus is connected to an outside air opening which is connected to the outside circumference of the application body via the outer tube for ventilation by a roundabout way, the ink absorber is divided into two so that it communicates with the ink in the ink reservoir only in the ink connecting opening, and in the ink flow path the relation, $A<B<C$, is held, where A represents the density or capillary force of the ink absorber in the large-diameter portion of the inner tube, which is the rear portion of the flow path on the ink absorber side, B represents the density or capillary force of the capillary member arranged in the small-diameter portion of the inner tube, which is the front portion of the flow path on the ink absorber side, and C represents the density or capillary force of the capillary member arranged in the application body's flow tube which is the ink flow path on the application body side.

2. The applicator according to claim 1, further comprising a joint tube having: an upper portion made up of a double tube that consists of an inner tube and an outer tube for ventilation and a lower portion made up of application body's flow tube such that the upper portion and the lower portion are integrally formed with each other; an ink connecting opening which opens from the outside circumference of the outer tube for ventilation toward the inside of the inner tube; and a ventilation annulus formed by combination of the inner wall of the outer tube for ventilation and the outer wall of the inner tube for allowing the inside of the outer tube and the outside circumference of the application body's flow tube to communicate with each other, except in the ink connecting opening.

3. The applicator according to claim 2, wherein a portion with a strong capillary action and a portion with a weak capillary action are formed in the opening of said ink connecting opening provided in said joint tube by shaping the opening in such a manner as to decrease the area of the transverse section of the opening from its outside circumference toward its inside circumference or providing the opening with a concavo-convex portion that creates a wide-clearance portion and a narrow-clearance portion on its inner circumference wall.

4. The applicator according to claim 1, wherein a portion with a strong capillary action and a portion with a weak capillary action are formed in the opening of said ink connecting opening provided in said joint tube by shaping the opening in such a manner as to decrease the area of the transverse section of the opening from its outside circumference toward its inside circumference or providing the opening with a concavo-convex portion that creates a wide-clearance portion and a narrow-clearance portion on its inner circumference wall.

* * * * *